US005441178A

United States Patent [19]

Wysocki

[11] Patent Number: 5,441,178

[45] Date of Patent: Aug. 15, 1995

[54] OVERCAP FOR PUMP STYLE DISPENSER

[75] Inventor: J. Christopher Wysocki, Stow, Ohio

[73] Assignee: GOJO Industries, Inc., Cuyahoga Falls, Ohio

[21] Appl. No.: 231,755

[22] Filed: Apr. 25, 1994

[51] Int. Cl.[6] ..... B67D 5/06

[52] U.S. Cl. ..... 222/182; 222/321.7

[58] Field of Search ..... 222/182, 321, 402.13

[56] References Cited

U.S. PATENT DOCUMENTS 3,216,624 11/1965 Corsette ..... 222/182
3,216,625 11/1965 Corsette ..... 222/182
3,263,869 8/1966 Corsette ..... 222/182

*Primary Examiner*—Gregory L. Huson
*Attorney, Agent, or Firm*—Reese Taylor

[57] ABSTRACT

An overcap for use with a pump type dispenser comprises a generally cylindrical body having an open end and a closed end with the open end being sized to be press-fit over the closure member which secures the pumping unit to the container with which it is associated. The overcap body has a generally axially extending opening therein so that the spout of the pump may project therethrough. One or more radially inwardly directed flats may be provided adjacent the open end of the body to enhance engagement with the closure regardless of manufacturing variances therein. Further, at least one elongate, generally axially extending rib may be provided on the inner wall of the body to engage the top of the closure upon force being applied to the closed end to limit axial movement of the overcap toward the container.

15 Claims, 2 Drawing Sheets

OVERCAP FOR PUMP STYLE DISPENSER

BACKGROUND OF THE INVENTION

This invention relates in general to protective overcaps for use in storage and shipping of containers and relates in particular to an overcap for such use with a pump style dispenser having a projecting dispensing nozzle or spout.

DESCRIPTION OF THE PRIOR ART

Many products, such as soap, lotion, etc., are packaged and sold in various types of dispensers. Many of these dispensers include a container body having a threaded neck at the top and a pump type dispensing unit or pumping unit secured to the threaded neck.

Many of these pumping units include a closure for attachment to the neck of the container and a stem which projects upwardly therefrom with a dispensing spout or nozzle extending normally to the axis of the stem. Many also include an enlarged pressure receiving member on the top of the stem whereby the user may apply thumb or finger pressure to the unit to depress the stem and dispense the contents through the spout or nozzle.

These pumping units constitute an effective means for dispensing the contents of the container, but are susceptible to damage or inadvertent actuation in shipment or storage. There are several ways in which inadvertent dispensing of the fluid contained in the container and damage to the pumping mechanism can be prevented.

Thus, with many of these pumping units, a snap- or press-fit protective overcap is utilized. In some instances, the overcap, such as commonly found on spray paint cans, is dimensioned so as to substantially approximate the dimension of the container itself with the overcap engaging a bead on the top of the container. In other instances, such as, for example, some hair sprays which do not have a dispensing spout but merely have an orifice in the top of the stem through which the material can be ejected, a simple cylindrical cap is placed over the stem and engages the closure. A still further method of protecting these pumping units involves the use of a clip which can be affixed to the stem between the top and the closure and which will impede axial movement of the stem and prevent it from being depressed so as to actuate the actual pumping mechanism and dispense material inadvertently.

All of these prior art solutions to the problem are presumably adequate for the purposes for which they have been designed. None of them, however, solve all of the potential problems.

For one thing, of course, it is desirable to avoid inadvertent dispensing during shipment. These containers are generally packed in boxes or cartons and, of course, are susceptible to inadvertent actuation if the pumping unit is exposed and accidentally comes into contact with other containers, the shipping container itself, etc.

For another thing, it is desirable to avoid damage to the pumping mechanism. These dispensers are commonly grasped by the pumping mechanism by careless users or employees, and it is, of course, always possible to damage or even break off the stem, particularly adjacent to its point of connection to the container which is the most vulnerable point. Careless users or handlers will often just reach for the container and grasp the most readily available portion thereof which, unfortunately, happens to be the pumping assembly or unit.

Therefore, it is thought to be desirable to provide an overcap which protects this mechanism during shipment, storage and, in fact, even during use from both inadvertent actuation and from damage.

SUMMARY OF THE INVENTION

It has been found that all of the objects above described can be achieved by providing an overcap which is sized so as to be press- or snap-fit over the closure which interconnects the pumping unit to the container.

It has further been found that an improved overcap of this type can be designed to accommodate a pumping mechanism which includes a projecting spout by providing a through opening or slot in the wall of the overcap through which the spout may project.

It has further been found that damage to the pumping unit through careless handling can be prevented by providing an overcap which is sized so as to have an interior dimension which approximates or just slightly exceeds the planar dimensions of the pump head, whereby, even if one grasps the container by the projecting dispensing nozzle or spout, the stem of the lo pumping mechanism is prevented from flexing to any great degree and is thereby protected from damage.

Accordingly, production of an improved overcap of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
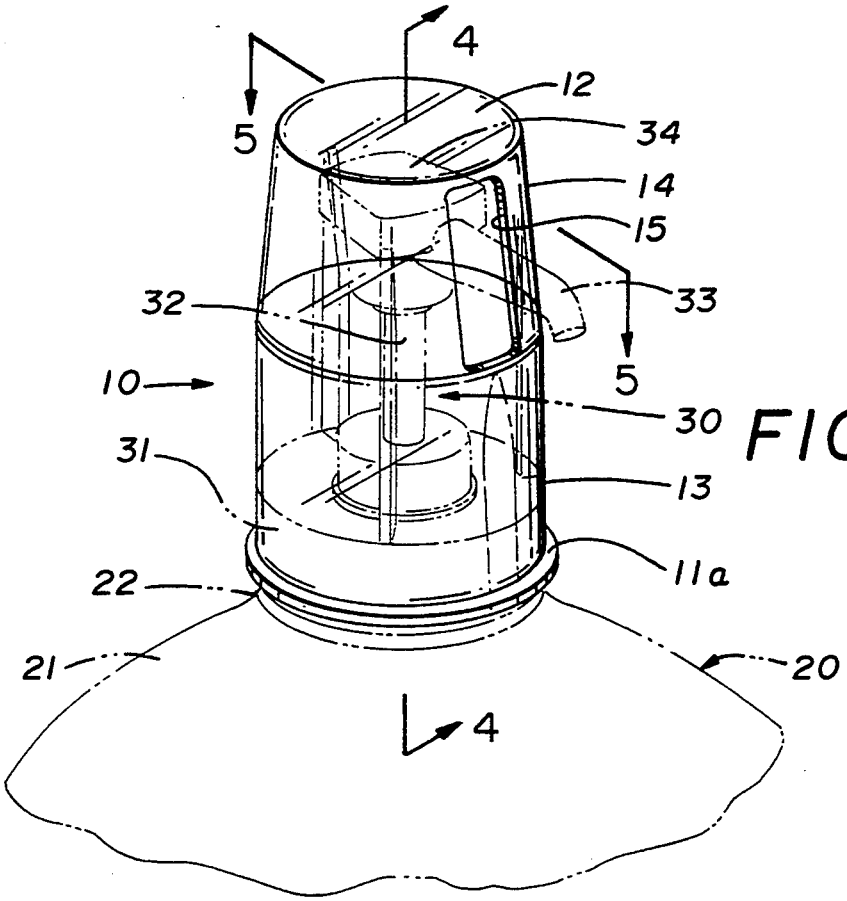
FIG. 1 is a perspective view of the improved overcap in place on a dispenser of the type referred to herein.
Figure 2:
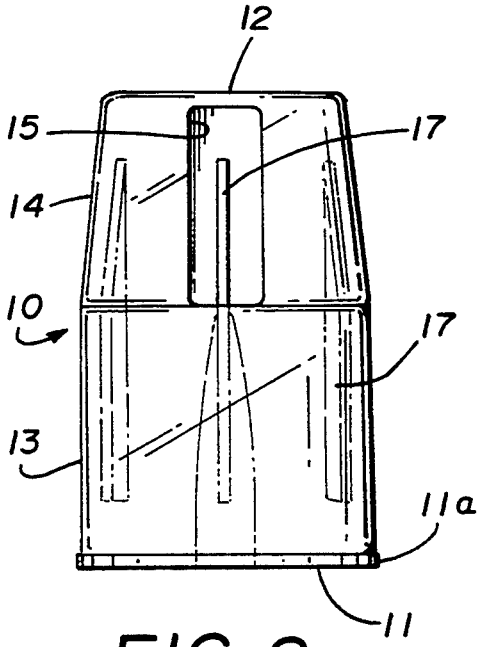
FIG. 2 is a front elevational view of the improved overcap.
Figure 3:
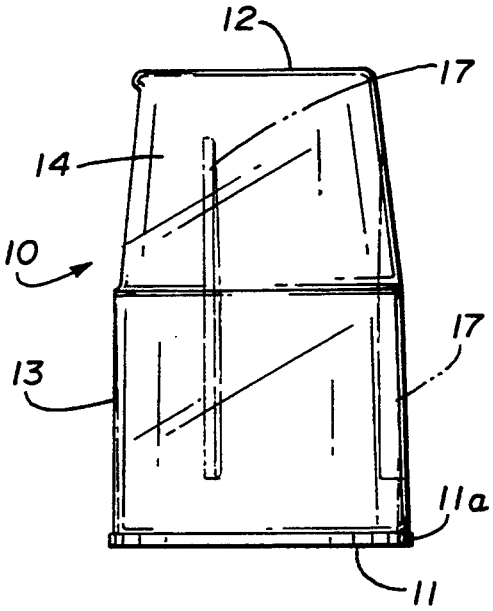
FIG. 3 is a side elevational view of the improved overcap.
Figure 4:
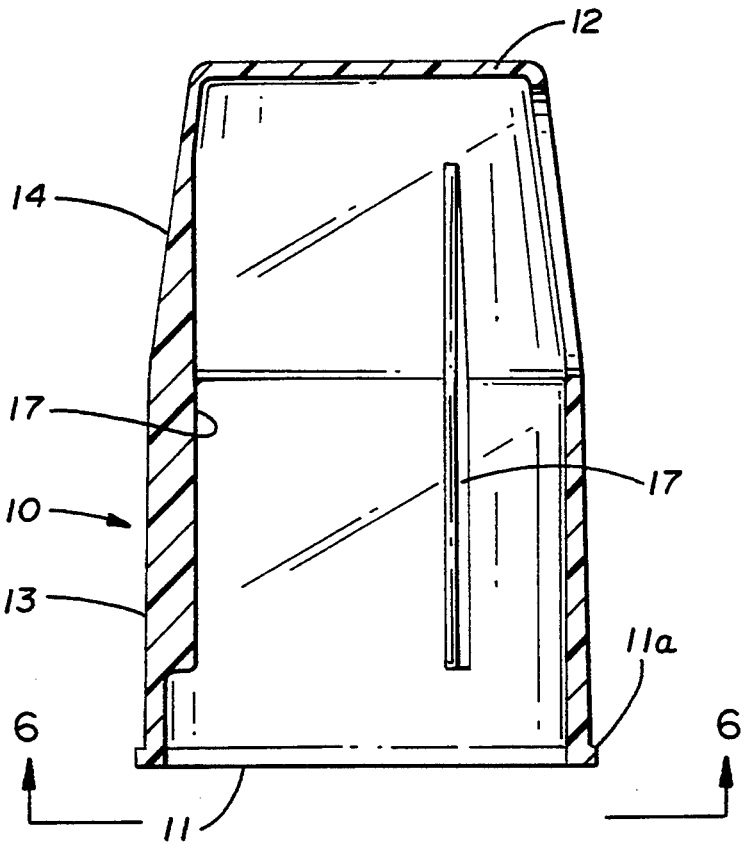
FIG. 4 is a sectional view taken along the lines 4—4 of FIG. 1.

Referring to FIG. 1 of the drawings, it will be seen that the assembly with the overcap in place includes the overcap 10, the container 20, and the pumping unit or mechanism 30.

Container 20 includes a body 21 and an upwardly extending projection or neck 22 to which the pumping mechanism 30 may be attached. Commonly, the neck 22 is threaded or has a bayonet type rib to facilitate such attachment.

To that end, the pumping mechanism 30 includes a closure 31 which attaches or engages the extension 22 of container 20, a projecting stem 32 which extends upwardly from the closure 31, a dispensing spout or nozzle 33 which projects outwardly at substantially right angles to the long axis of the stem 32, and a pressure member 34 which is integral with or fixed to the top end of the stem 32. In operation, the pressure member 34 is normally utilized by the user engaging it with a finger, thumb or hand so as to depress the stem 32 relatively to the closure 31 to disperse the contents of container 20.

No detailed explanation of the operation of the pump, other than that already given, will be set forth herein inasmuch as these pumps are very conventional and their general construction and operation are well known to those of ordinary skill in this art.

Suffice it to say, as previously noted, however, that the projecting pump mechanism, with its relatively tall, thin stem 32, is susceptible to damage during shipment or careless handling. Also, if uncovered, it is obviously susceptible to inadvertent dispensing of the material during shipping and handling by accidental depression of stem 32.

To avoid this, then, the overcap 10 can be seen from FIGS. 1 through 4 to be a generally cylindrical member having an open end 11 and a closed end 12. In the form of the invention illustrated in the drawings, it will be seen that the cylindrical body has a substantially straight wall portion 13 extending upwardly toward the closed end 12 from the open end 11 and the flange 11*a*.

A tapered wall portion 14 extends downwardly from the closed end 12 and merges into the substantially straight wall portion 13 in the form of the invention shown and as clearly shown in the drawings. A through aperture or slot 15 is disposed in the upper portion of the overcap 10 and, in the form of the invention illustrated in the drawings, is disposed in the tapered wall portion 14 thereof.

Figure 5:
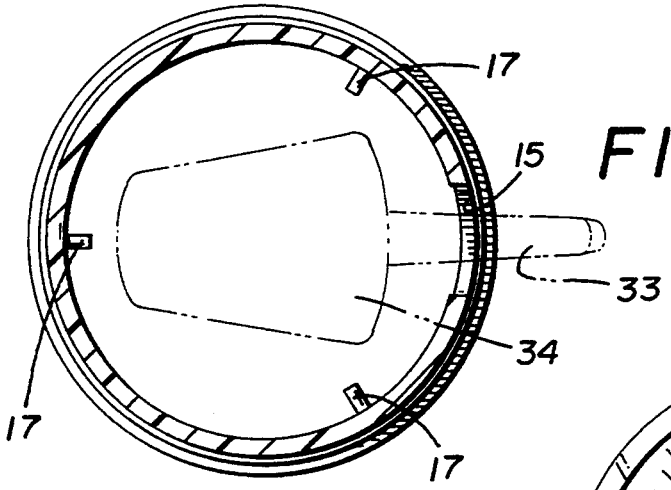
FIG. 5 is a sectional view taken along the lines 5—5 of FIG. 1.

As can clearly be seen in FIGS. 1 and 5 of the drawings, the dispensing spout or nozzle 33 is disposed so as to project through the opening 15. Inadvertent depression of the stem 32 is prohibited by the closed end 12 of the overcap. If no other locking mechanism is used, however, the unit would still be operative if the nozzle 33 is itself intentionally depressed.

If a stem clip of the type previously described is utilized, the dispenser will be rendered not only safe from damage, but totally inoperative.

Further, it will be seen from FIGS. 1 and 5 of the drawings that the pressure member 34 and the top portion of the overcap 10 are dimensioned so that there is only very slight clearance between the inner wall of the overcap and the corners or periphery of the pressure member 34. In this way, even if one grasps the container by the projecting nozzle or spout 33 with overcap 10 in place, very little flexing of the stem 32 would be permitted, and it will, therefore, be protected against damage.

Figure 6:
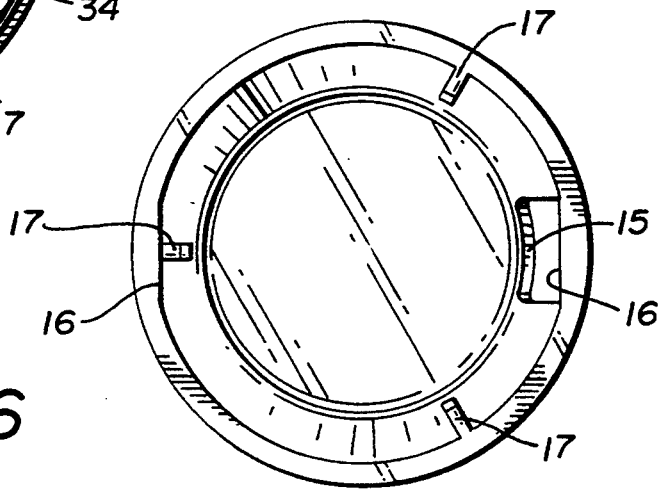
FIG. 6 is a bottom plan view taken along the lines 6—6 of FIG. 4.

Inasmuch as overcap 10 is press- or snap-fit on closure 31, and inasmuch as a tight fit is desired, it has been found desirable to provide a means for accommodating manufacturing variances in the closure diameter. To that end, overcap 10 may be formed with opposed, radially inwardly directed flats 16,16 adjacent open end 11, as clearly shown in FIG. 6 of the drawings. Thus, if the diameter or shape of closure 31 is within standard industry variations, the overcap 10 will still be capable of secure engagement.

Flats 16,16 also facilitate attachment of the pump assembly to the container. In many instances, the overcap and pump assembly are preassembled into a subassembly and then attached to the container as one step in the filling operation. That is, after the container has been moved along an assembly line and filled, the subassembly of overcap and pump is grasped by a machine and torqued onto the container. Often, complemental splines are required on the cap and the attachment tool to facilitate this operation. With the provision of flats 116,16, which function somewhat like a clutch, these are not necessary.

Furthermore, and in furtherance of the object of protecting pumping unit 30, means may be provided to avoid having the overcap 10 jammed onto the container 20 in such a way as to make removal difficult or even impossible. In that regard, for example, if severe pressure is exerted on closed end 12, the overcap 10, being usually somewhat flexible, may be forced down over closure 31 and into engagement with the top of container 20 itself. Inasmuch as the container 20 may be of relatively soft material, the overcap 10 actually deform the shoulder area of the container can become embedded in the container.

To prevent this, one or more elongate ribs 17 may be provided on the inner surface of overcap 10 and formed with an inner diameter such that any excessive downward force on closed end 12 will cause the bottom ends of the ribs 17 to engage the top of closure 31 and prevent further downward movement of the overcap 10.

It will be noted, too, from the drawings that the overcap is illustrated as being transparent, although this feature is optional and the overcap may be opaque, tinted or translucent if desired.

While a full and complete description of the invention has been set forth in accordance with the dictates of the Patent Statutes, it should be understood that modifications can be resorted to without departing from the spirit hereof or the scope of the appended claims.

What is claimed is:

1. An overcap for use with a dispenser of the type including a container and a pumping unit attachable thereto, the pumping unit being releasably attached to the container by a closure and having a projecting stem with a pressure member on the distal end thereof and dispensing spout, the overcap comprising:

a) a generally cylindrical body having a substantially closed wall, an open end and a closed end;

b) said open end being sized for press-fit engagement with the closure; said body having a height dimension slightly greater than the projecting height of the stem;

d) a through opening in the wall of said cylindrical body for projecting receipt of the dispensing spout; and e) said closed end of said body overlying the pressure member when said body is in engagement with said closure.

2. The overcap of claim 1 wherein said cylindrical body is transparent.

3. The overcap of claim 1 wherein said cylindrical body is opaque.

4. The overcap of claim 1 wherein said cylindrical body is tinted.

5. The overcap of claim 1 wherein said cylindrical body is translucent.

6. The overcap of claim 1 wherein said through opening extends from a point spaced from said closed end of said body toward said open end.

7. The overcap of claim 1 wherein said body has a substantially straight wall portion extending from said open end at least part of the distance from said open end toward said closed end; and a tapered wall portion extending from said closed end at least part of the distance toward said open end and merging into said substantially straight wall portion.

8. The overcap of claim 7 wherein said through opening is disposed in said tapered wall portion.

9. The overcap of claim 1 wherein said body has an interior dimension adjacent said closed end slightly greater than the transverse dimensions of the pressure member.

10. The overcap of claim 1 wherein at least one radially extending flat is provided on the inner wall of said cylindrical body adjacent said open end.

11. The overcap of claim 1 wherein at least one generally axially extending rib is provided on the inner wall of said cylindrical body extending from a point adjacent said closed end to a point spaced from said open end.

12. An overcap for use with a :dispenser of the type including a container and a pumping unit attachable thereto, the pumping unit being releasably attached to the container by a closure and having a projecting stem and dispensing spout, the overcap comprising:

a) a generally cylindrical body having an open end and a closed end;

b) said open end being sized for press-fit engagement with the closure;

c) said body having a height dimension slightly greater than the projecting height of the stem;

d) a through opening in the wall of said cylindrical body for projecting receipt of the dispensing spout;

e) said body having a substantially straight wall portion extending from said open end at least part of the distance from said open end toward said closed end and a tapered wall portion extending from said closed end at least part of the distance toward said open end and merging into said substantially straight wall portion; and f) said through opening being disposed in said tapered wall portion.

13. The overcap of claim 12 wherein said pump includes an enlarged pressure member disposed on the projecting end of said stem; said body having an interior dimension adjacent said closed end slightly greater than the transverse dimensions of the enlarged pressure member.

14. The overcap of claim 12 wherein at least one radially extending flat is provided on the inner wall of said cylindrical body adjacent said open end.

15. The overcap of claim 12 wherein at least one generally axially extending rib is provided on the inner wall of said cylindrical body extending from a point adjacent said closed end toward said open end.

* * * * *

UNITED STATES PATENT AND TRADEMARK OFFICE

CERTIFICATE OF CORRECTION

PATENT NO. : 5,441,178

DATED : August 15, 1995

INVENTOR(S) : J. Christopher Wysocki

It is certified that error appears in the above-identified patent and that said Letters Patent is hereby corrected as shown below:

In Column 2, line 24, delete "lo";

In Column 4, line 1, delete "116,16" and substitute therefor —16.16—;

In Column 4, line 40, between "closure;" and "said" insert —c)—; and

In Column 5, line 12, delete ":dispenser" and substitute therefor —dispenser—.

Signed and Sealed this

Twenty-eighth Day of November 1995

*Attest:*

Bruce Lehman

BRUCE LEHMAN

*Attesting Officer*

*Commissioner of Patents and Trademarks*